US005636768A

United States Patent [19]

Yamada

[11] Patent Number: 5,636,768

[45] Date of Patent: Jun. 10, 1997

[54] MANUALLY OPERATED TRIGGER TYPE DISPENSER

[75] Inventor: Akihiko Yamada, Onoda, Japan

[73] Assignee: Canyon Corporation, Tokyo, Japan

[21] Appl. No.: 525,906

[22] Filed: Sep. 8, 1995

[30] Foreign Application Priority Data

Sep. 16, 1994 [JP] Japan ..... 6-246809

[51] Int. Cl.[6] ..... B67D 5/42

[52] U.S. Cl. ..... 222/383.1; 222/494; 222/496; 137/509

[58] Field of Search ..... 222/380, 383.1, 222/385, 494, 496; 239/333, 570; 137/509, 510

[56] References Cited

U.S. PATENT DOCUMENTS

| | | | |
|---|---|---|---|
| 3,794,213 | 2/1974 | Schwartzman | 222/494 X |
| 4,174,790 | 11/1979 | Nozawa et al. . | |
| 4,273,290 | 6/1981 | Quinn . | |
| 4,305,530 | 12/1981 | Nozawa . | |
| 4,365,751 | 12/1982 | Saito et al. . | |
| 4,624,413 | 11/1986 | Corsette | 222/383.1 X |
| 4,819,835 | 4/1989 | Tasaki | 222/383.1 |
| 4,921,017 | 5/1990 | Tada . | |
| 4,989,790 | 2/1991 | Martin et al. . | |
| 5,088,629 | 2/1992 | O'Neill | 222/383.1 X |
| 5,303,867 | 4/1994 | Peterson | 222/383.1 X |
| 5,368,234 | 11/1994 | Foster et al. | 239/333 |
| 5,551,636 | 9/1996 | Foster et al. | 222/383.1 X |

FOREIGN PATENT DOCUMENTS

| | | |
|---|---|---|
| 0688608 A1 | 12/1995 | European Pat. Off. . |
| 2390213 | 12/1978 | France . |
| WO91/03321 | 3/1991 | WIPO . |

*Primary Examiner*—Andres Kashnikow
*Assistant Examiner*—Kenneth Bomberg
*Attorney, Agent, or Firm*—Frishauf, Holtz, Goodman, Langer & Chick

[57] ABSTRACT

A flowing-out passage consists of a small-diameter portion located at the cylinder side and a large-diameter portion located at the orifice side. Provided in the passage is a secondary valve. Skirt-shaped seals are mounted on a secondary valve and set in sliding contact with the inner surface of the flowing-out passage to prevent communication between the small-diameter and large-diameter portions. The secondary valve has a valve spring, a valve body, and a valve seat located at the orifice side. The valve spring set the valve body in contact with the valve seat. Liquid pressures are applied on the secondary valve on both sides. The valve body can be moved away from the valve seat against the force of the valve spring, by a difference between the liquid pressures.

8 Claims, 4 Drawing Sheets

MANUALLY OPERATED TRIGGER TYPE DISPENSER

BACKGROUND OF THE INVENTION

1. Field of the Invention

The present invention relates to a manually operated trigger type dispenser which comprises a trigger, a cylinder and a piston provided in the cylinder and connected to the trigger and in which liquid is sucked into the cylinder and pressurized therein and made to flow out when the trigger is pulled to reciprocate the piston in the cylinder.

2. Description of the Prior Art

The destruction of the ozone layer is now a great environmental problem. Hence, more and more attention is drawn to manually operated trigger type dispensers which use no Freon gas and in which the piston is reciprocated in the cylinder to force out liquid. A dispenser of this type is removably connected to a container holding liquid, by means of a bottle cap set in engagement with the male screw made on the mouth of the container.

A manually operated trigger type dispenser comprises a dispenser body, a cylinder, a piston provided in the cylinder, a trigger connected to the piston, a suction tube, and a nozzle. In the dispenser, liquid is sucked upward from a container through the suction tube, forming a flowing-in passage which communicates with the suction tube. The dispenser has a flowing-out passage which connects the orifice (outlet port) of the nozzle to the cylinder. In the flowing-in passage, a first one-way valve (primary valve) is provided to control the flow of liquid from the container to the cylinder. In the flowing-out passage, a second one-way valve (secondary valve) is provided to control the flow of liquid from the cylinder to the orifice.

The trigger is swingably attached to the dispenser body which has a substantially U-shaped cross-section. Biased by a return spring, the trigger stays at its projecting position (initial position). When pulled against the urging force of the return spring, the trigger is swung to its pulled position, causing the piston to slide in the cylinder. When the trigger is released, it is swung back to the initial position due to the urging force of the return spring.

As the trigger returns from the pulled position to the initial position (i.e., the projecting position), the piston is moved, also from its pushed-in position to its initial position. As a result, the interior of the cylinder is negatively pressurized, opening the primary valve and closing the secondary valve. By virtue of the negative pressure, the liquid flows from the container into the cylinder through the suction tube, the flowing-in passage and the primary valve.

When the trigger is pulled again, the piston is moved to the pushed-in position, pressurizing the liquid in the cylinder. The liquid thus pressurized, closes the primary valve, flows into the flowing-out passage, pushes the secondary valve open, and flows outwards from the orifice (outlet port) of the nozzle.

The secondary valve tightly contacts a valve seat by virtue of the urging force of a valve spring, preventing the liquid from leaking from the cylinder. If the valve spring has a small urging force, the secondary valve is opened before the liquid in the cylinder is pressurized sufficiently and the liquid then flows out. Not sufficiently pressurized yet, the liquid flows out in drops, not in the form of a spray stream which extends for some distance as is desired. Particularly, in a manually operated trigger type dispenser which has a spinner (a member for forming an eddy flow) at the back of the orifice, it cannot make an eddy flow unless it is pressurized sufficiently. Consequently, it flows out but not in the form of a spray stream.

If the spring of the secondary valve has a great urging force, the liquid in the cylinder cannot flows out unless it is pressurized sufficiently. If the liquid is pressurized sufficiently, it can be forced out in the form of a spray stream. To pressurize the liquid sufficiently, however, the trigger needs to be pulled with a great force. This would make it difficult for physically feeble persons to use the trigger type dispenser.

All liquid pressurized in the cylinder does not flow out; a part of it remains in the cylinder. Nor does all liquid forced from the cylinder flow out from the orifice; a part of it remains in the flowing-out passages which extends from the cylinder to the orifice. When the trigger is released and the piston is thereby moved to the initial position, the interior of the cylinder is negatively pressurized. The resultant negative pressure causes the liquid remaining in the flowing-out passage to flow back into the cylinder. All liquid in the flowing-out passage does not flow back into the cylinder; a part of it still remains in the flowing-out passage.

Due to the negative pressure in the cylinder, the liquid in the container is sucked into the cylinder. The liquid drawn up into the cylinder is under normal pressure before the trigger is pulled again. By contrast, the liquid remaining in the cylinder is still pressurized and under a higher pressure. Hence, the liquid in the cylinder, i.e., the mixture of the liquid sucked from the container and the liquid remaining in the cylinder, is under a residual pressure somewhat higher than normal pressure. Due to the residual pressure, the liquid remaining in the flowing-out passage is liable to dribble from the orifice. This tendency is particularly conspicuous if the spring of the secondary valve has a small force.

SUMMARY OF THE INVENTION

It is therefore an object of the present invention to provide a manually operated trigger type dispenser which can pressurize liquid sufficiently and forces it out in the form of a spray stream, without applying a great pull to the trigger.

It is another object oft he invention to provide a manually operated trigger type dispenser which can not only pressurize liquid sufficiently and forces it out in the form of a spray stream, without applying a great pull to the trigger, but also prevent liquid from dribbling from the orifice despite of the residual pressure in the cylinder.

It is still another object of the invention to provide a one-way valve which can allow the passage of highly-pressurized liquid, without using a valve spring which has a great force.

According to the present invention, there is provided a manually operated trigger type dispenser in which the liquid applies different pressures to the sides of the secondary valve, opening the secondary valve by the difference between the pressures. More specifically, the flowing-out passage containing the secondary valve comprises a small-diameter portion connected to the cylinder and a stepped large-diameter portion connected to the orifice. The secondary valve has a skirt-shaped seal which slides on the inner surface of the flowing-out passage and which prevent communication between the small-diameter and large-diameter portions of the flowing-out passage.

The secondary valve comprises a valve body, a valve seat and a valve spring. The valve seat is provided in the large-diameter portion of the flowing-out passage. The valve spring holds the valve body in tight contact with the valve seat. The liquid in the small-diameter portion of the passage applies a pressure on the valve body in one direction. On the other hand, the liquid in the large-diameter portion of the passage applies a different pressure on the valve body in the opposite direction. The difference between these pressures separate the valve body from the valve seat against the force of the valve spring, thereby opening the secondary valve.

The secondary valve would not open until the liquid acquires a sufficiently high pressure. This means that the liquid flows from the cylinder to the orifice only after the liquid is sufficiently pressurized. Since the secondary valve is opened by the pressure difference described above, the valve spring need not be strengthened to supply the liquid from the cylinder under a high pressure. Since the valve spring need not be strengthened, it is unnecessary for the user to pull the trigger with a great force.

Needless to say, the spring of the secondary valve can be reinforced, without increasing the trigger-pulling force beyond a limited range. The liquid can thereby be prevented from dribbling from the orifice even if a pressure (residual pressure) is applied on the liquid remaining in the cylinder.

Moreover, the cylinder and the piston are designed so as to prevent any pressurized liquid from remaining in the cylinder, thereby to spray the liquid to from the orifice without causing the liquid to dribble.

DETAILED DESCRIPTION OF THE PREFERRED EMBODIMENTS

A manually operated trigger type dispenser which is an embodiment of the present invention will be described in detail, with reference to the accompanying drawings.

Figure 1:
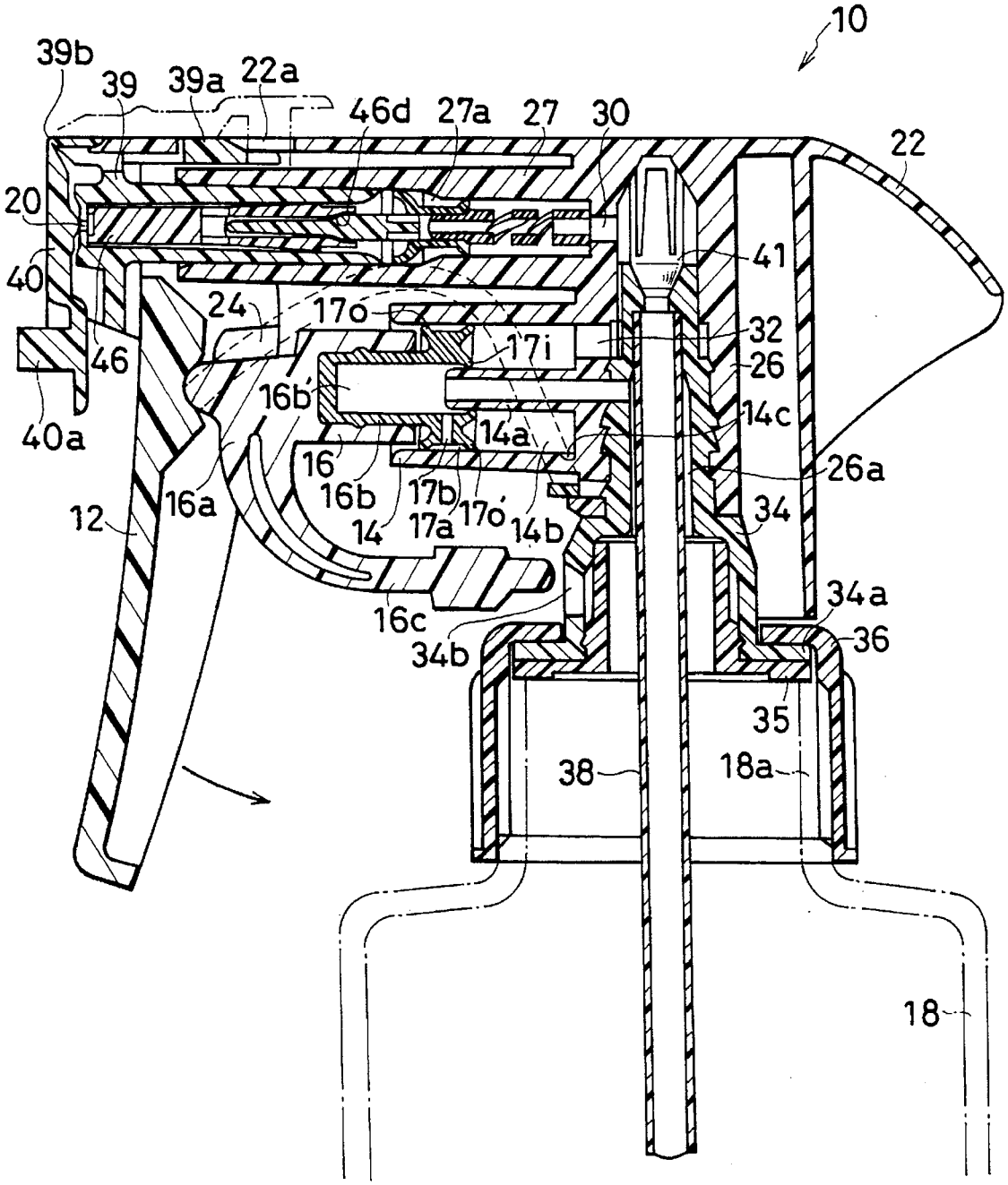
FIG. 1 is a vertical sectional view of a manually operated trigger type dispenser according to an embodiment of the present invention.

As shown in FIG. 1, the trigger type dispenser 10 comprises a swingable trigger 12, a cylinder 14, a piston 16, and an orifice 20. The cylinder 14 communicates with liquid passages. The piston 16 slides back and forth in the cylinder 14 when the trigger 12 is pulled and released. The orifice 20 is provided at the distal end of a nozzle. The trigger type dispenser 10 can be connected to the mouth 18*a* of a container 18. When the piston 16 slides in the cylinder 14, as the trigger 12 is operated, liquid is sucked upwards from the container 18 into the cylinder 14, pressurized in the cylinder 14 and forced out from the orifice 20.

The trigger type dispenser 10 further comprises a dispenser body 22 which has a substantially U-shaped cross-section. The distal end of the trigger 12 is held in the gap between the opposing side walls of the body 22 such that the trigger 12 can be swung. The trigger 12 is urged toward its initial position, or toward the left in FIG. 1, by a return spring 24 which is a leaf spring.

As can be seen from FIG. 1, the dispenser body 22 has a vertical cylinder 26 and a horizontal cylinder 27 which are integral with each other. The cylinder 14 is integrally formed with the vertical cylinder 26. It extends from the vertical cylinder 26 in parallel to the horizontal cylinder 27 and is located below the horizontal cylinder 27. The vertical cylinder 26 defines a vertical passage (flowing-in passage) 26*a*, whereas the horizontal cylinder 27 defines a horizontal passage (flowing-out passage) 27*a*. These passages 26*a* and 27*a* communicate through a hole 30 made in the side wall of the vertical cylinder 26. The flowing-in passage 26*a* communicates with the cylinder 14 through another hole 32 which is made in the side wall of the vertical cylinder 26.

A hollow cylindrical valve housing 34 having a flange 34*a* at its lower end is fitted into the flowing-in passage 26*a* from below and, hence, incorporated in the dispenser body 22. A suction tube 38 is fitted into the valve housing 34 from below, too. The valve housing 34 has an inversely tapered valve seat at its top. The valve seat is located above the suction tube 38. Mounted on the valve seat is a primary valve 41. In the present embodiment, the primary valve 41 is of the type shown in FIGS. 1 and 2 of U.S. Pat. No. 4,921,017, which has three blades.

The valve housing 34 has two coaxial holes, a large hole in its lower half and a small hole in its upper half. The large hole is a diameter much greater than the outer diameter of the suction tube 38. An annular space is therefore provided between the inner surface of the large hole and the suction tube 38. The annular space communicates with the interior of the container 18.

As can be clearly understood from FIG. I, the liquid in the container 18 is sucked up into the suction tube 38 when a negative pressure is generated in the cylinder 14. Forcing open the primary valve 41, the liquid flows from the tube 38 via the hole 32 into the cylinder 14. The liquid in the cylinder 14 is pressurized as the trigger 12 is pulled, pushing the piston 16 backward. The liquid further flows into the flowing-out passage 27*a* through the hole 30. The liquid is finally forced out from the orifice 20.

The trigger type dispenser 10 is removably connected to the container 18 by a bottle cap 36. More precisely, the bottle cap 36 is mounted on and set in screw engagement with the mouth of the container 18, and the flange 34*a* of the valve housing 34 is clamped between the bottle cap 36 and the mouth of the container 18. The valve housing 34 has a hole 34*b* which is usually closed by a packing 35. The hole 34*b* can be opened by the trigger 12 to prevent generation of a negative pressure in the container 18.

A nozzle 39, which is a bottomed hollow cylinder, is inserted in the flowing-out passage 27*a*, i.e., the horizontal passage provided in the dispenser body 22. The nozzle 39 has a hook 39*a* on its top. The hook 39*a* is so bent that it is fitted in a gap between the top of the dispenser body 22 and the horizontal cylinder 27. The nozzle 39 is attached to the dispenser body 22, with the hook 39*a* set in a holding hole 22*a* made in the top wall of the body 22. The flowing-out passage 27*a* comprises a small hole and a large hole which are coaxial with each other. The small hole (i.e., the right half of the passage 27*a*) communicates with the cylinder 14, while the large hole (i.e., the left half of the passage 27*a*) communicates with the orifice 20. The flowing-out passage 27*a* has a stepped portion where the small hole and the large hole meet each other. A secondary valve 42 is arranged in the flowing-out passage 27*a*, positioned in the vicinity of the stepped portion thereof.

A nozzle cover 40 is connected to the nozzle 39 by a hinge 39*b* which is integrally formed with the nozzle cover 40. The nozzle cover 40 is urged onto the nozzle 39, closing the orifice 20, as long as the trigger type dispenser 10 is not used. To use the dispenser 10, a user rotates the nozzle cover 40 around the hinge 39*b* into the position indicated by one-dot, one-dash line in FIG. 1. Once set in this position, the nozzle cover 40 has its one part held in the holding hole 22*a* of the dispenser body 22 and would not block the stream of liquid coming from the orifice 20.

Like the secondary valve 42, a spinner 46 (an eddy-flow forming member) is provided in the flowing-out passage 27*a*. The spinner 46 is located at the nozzle 39. Due to its own urging force, the secondary valve 42 is pressed onto the fight end of the spinner 46. Thus, the spinner 46 is pushed onto the proximal end of the nozzle 39 at the back of the orifice 20.

Figure 2:
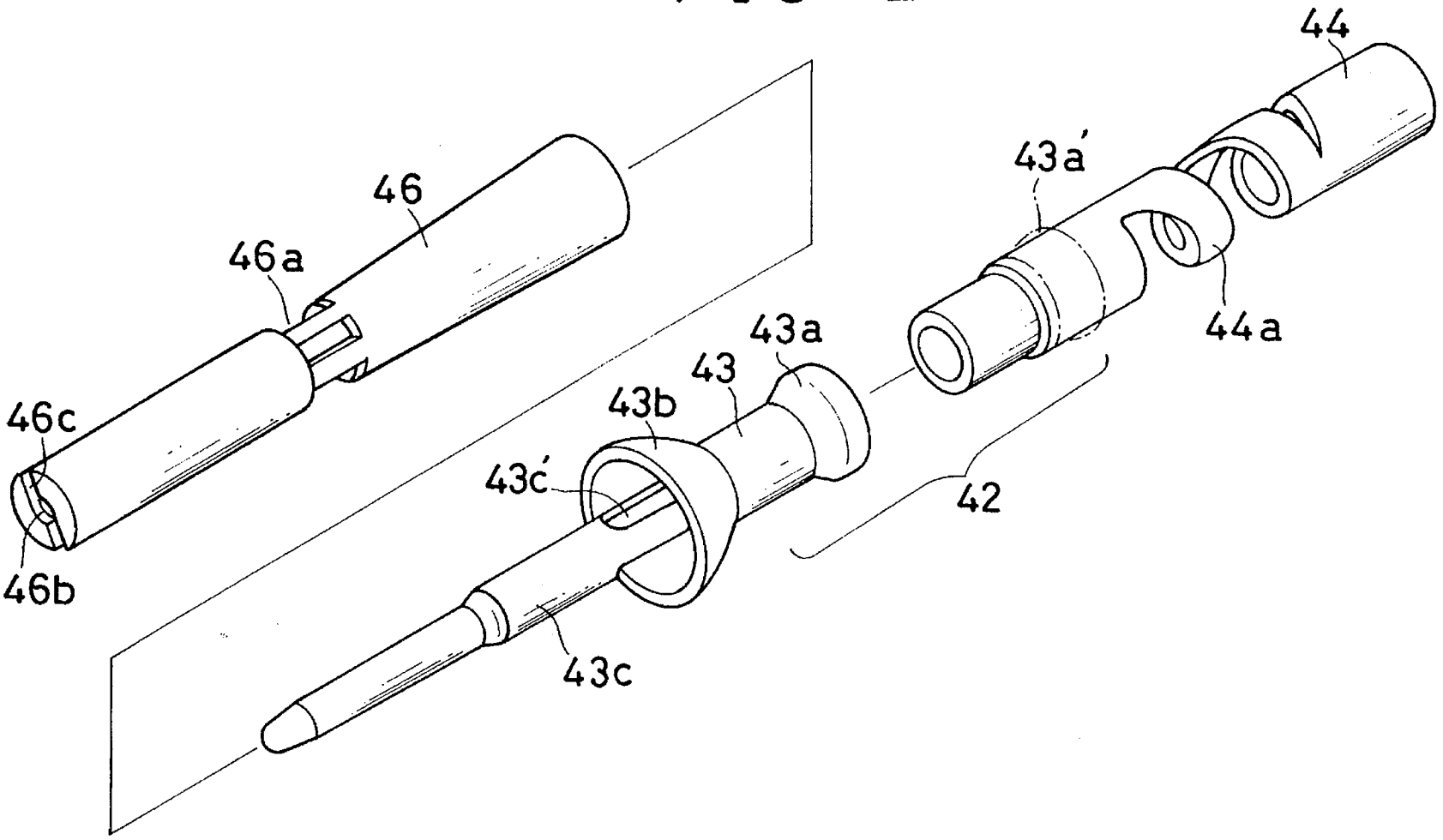
FIG. 2 is an exploded perspective view showing the spinner and the secondary valve, both incorporated in the dispenser shown in FIG. 1.

As can be understood from FIG. 2 as well as FIG. 1, the spinner 46 consists of left and right halves. The left half is a solid cylinder, whereas the fight half is a hollow cylinder. The right half has slits 46*a* cut in its distal end portion. The left half has an circular recess 46*b* and two grooves 46*c*, all in its distal end. The grooves 46*c* extend tangent to the circular recess 46*b*. Liquid can flow from the cylinder 14 through the right half of the spinner 46, finds its way through the slits 46*a*, and further flows along the grooves 46*c* into the circular recess 46*b*. In the circular recess 46*b*, the liquid swirls until it flows from the orifice 20 in the form of a spray stream.

The secondary valve 42 comprises a thick plunger 43 and a thin plunger 44. Both plungers are made of plastics material. Like the secondary valve 42, the trigger 12, the cylinder 14, the piston 16, the body 22 and the return spring 24, which are other major components of the dispenser 10, are made of plastics material. After the lifetime of the dispenser 10 expires, all components of the dispenser 10 can be melted so that the plastics material may be used again. The dispenser 10 is advantageous in view of recycle of resources.

Figure 3A:
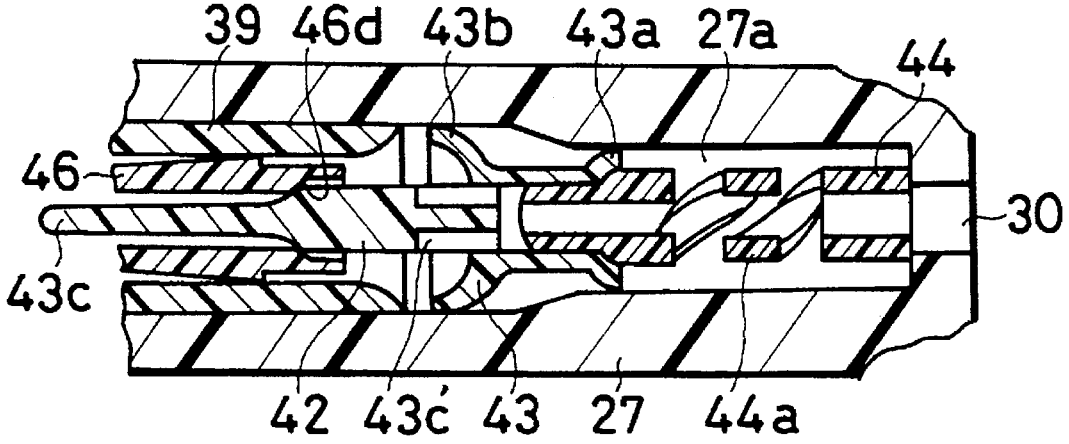
FIG. 3A is a sectional view of a part of the dispenser, showing the secondary valve located at its closed position.
Figure 3B:
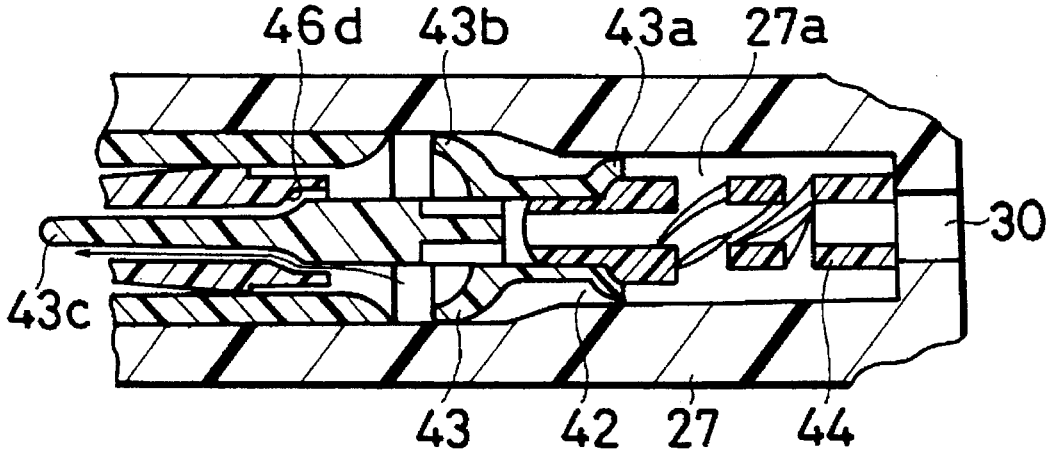
FIG. 3B is a sectional view of a part of the dispenser, showing the secondary valve located at its opened position.

The secondary valve 42 is controlled by a difference between two pressures applied on the plungers 43 and 44, respectively, in the opposite directions. To be more specific, as shown in FIGS. 1 to 3, the left end of the thin plunger 44 is fitted in the axial hole made in the right half of the thick plunger 43, such that the thin plunger 44 is axially aligned with the thick plunger 43. The thick plunger 43 and the thin plunger 44 are placed in the small hole and large hole of the, flowing-out passage 27*a*, respectively.

The thick plunger 43 is a hollow cylinder. It has a skirt-shaped seal 43*a* on the distal end, in which the distal end of the thin plunger 44 is fitted. It has a skirt-shaped seal 43*b* on other distal end. From other distal end of the thick plunger 43 there extends a rod-shaped valve body 43*c*. The valve body 43*c* consists of a thin distal portion and a thick proximal portion and has a stepped portion at the junction of the distal and proximal portions. As shown in FIG. 3A, the stepped portion contacts the valve seat 46*d* which is integrally made with the spinner 46. The proximal portion of the valve body 43*c* has elongated grooves 43*c'* in its circumferential surface. These grooves 43*c'* communicate with the axial hole of the thick plunder 43.

The thin plunger 44 is generally a hollow cylinder and has a middle spiral portion 44*a*. The spiral portion 44*a* functions as a valve spring. By virtue of the compressing force of the spiral portion 44*a*, the right end of the thin plunger 44 is pushed onto the periphery of that portion of the dispenser body 22 in which the hole 30 is made, and the valve body 43*c* of the thick plunger 43 is pushed onto the valve seat 46*d*. That is, the, spiral portion 44*a* of the thin plunger 44 pushes the secondary valve 42 to the left.

The liquid pressurized in the cylinder 14 flows via the hole 30 into the right (i.e., the small hole) of the flowing-out passage 27*a*. The liquid further flows into the left half (i.e., the thick hole) of the passage 27*a* through the axial hole of the thin plunger 44, the axial hole of the thick plunger 43 and the elongated grooves 43*c'* of the valve body 43*c*. As a result, the liquid applies pressures on the secondary valve 42 from the left and the right. The skirt-shaped seals 43*a* and 43*b* prevent the liquid from the right half of the flowing-out passage 27*a* to the left half thereof.

As described above, the left half of the flowing-out passage 27*a* has a larger cross section than the fight half. The seal 43*b* provided in the left half of the passage 27*a* has of course a larger diameter than the seal 43*a* located in the right half of the passage 27*a*. Hence, the liquid pressure exerted on the seal 43*b* from the left is higher than the liquid pressure applied on the seal 43*a* from the right. The secondary valve 42 is thereby urged to the right.

When the difference between the liquid pressures applied on the secondary valve 42 from the left and the right increases over the compression force of the spiral portion 44*a*, the valve body 43*c* of the secondary valve 42 slides to the right, away from the valve seat 46*d*, against the force of the spiral portion 44*a*. That is, the secondary valve 42 is opened. The liquid therefore flows to the spinner 46 through the flowing-out passage 27*a*, swirls at the spinner 46, forming an eddy flow, and is forced out from the orifice 20 in the form of a spray stream. The liquid may not be made into an eddy flow at the spinner 46.

In conventional trigger type dispensers, the liquid pressure is applied on the secondary valve from one side only, namely from the cylinder side. If the spring of the secondary valve exerts but an inadequate force, the liquid will flow under a pressure which is lower than desired. If the spring exerts an excessively large force, the user needs to pull the trigger with a large force.

In the present invention, the liquid pressures are applied on both sides of the secondary valve 42 to open the valve 42 by the difference between the pressures. The secondary valve 42 is not opened before the liquid in the cylinder 14 is pressurized sufficiently. Hence, the liquid flows from the cylinder 14 to the orifice 20 under a sufficiently high pressure. Although the liquid is highly pressurized, the middle spiral portion 44*a* of thin plunger 44, which functions as the valve spring, need not exert a large force. It is therefore unnecessary for the user to pull the trigger 12 with a great force in order to apply the liquid in the form of a spray stream. The trigger type dispenser 10 is easy to operate, even for persons who are physically feeble.

The secondary valve 42 may be replaced by another of any different structure, which can be opened and closed in accordance with the difference between the pressures applied on the both sides. For example, the spiral portion 44*a* of thin plunger 44, which is used as the valve spring, may be replaced by a sine-wave leaf spring of the type shown in FIG. 1 of U.S. Pat. No. 4,273,290 and FIG. 1 of U.S. Pat. No. 4,989,790 or by a pipe-shaped spring of the type shown in FIG. 4 of U.S. Pat. No. 4,365,751. Furthermore, the spiral portion 44*a* may be replaced by a valve spring which is not integral with the thin plunger 44 and is incorporated in the thin plunger 44. Nonetheless, it is desirable to form the spiral portion 44*a* (used as the valve spring) integral with the thin plunger 44 as shown in FIG. 2. The secondary valve 42 can be assembled more easily than otherwise.

As can be clearly understood, the skirt-shaped seal (small-diameter seal) 43*a* set in sliding contact in the fight half (small hole) of the flowing-out passage 27*a* suffices to prevent the liquid from flowing from the right half to the left half of the passage 27*a*, along the outer surface of the secondary valve 42. The seal 43*a* may therefore be mounted on the thin plunger 44, not on the thick plunger 43, and may be located on the left to the spiral portion 44*a* (namely, near the thick plunger 43), as indicated by a one-dot, one-dash line in FIG. 2.

In the present invention, the spring of the secondary valve 42 can be reinforced by the difference between the pressures applied on the valve 42 from the left and the right, without increasing the force required to pull the trigger 12. Hence, the liquid does not dribble from the orifice 20 despite of the pressure (i.e., the residual pressure) of the liquid remaining in the cylinder 14. The present embodiment is designed such that no pressurized liquid is allowed to remain in the cylinder 14.

More precisely, as shown in FIG. 1, the cylinder 14 is a double-cylinder, having a hollow cylindrical member 14*a* which protrudes horizontally from the dispenser body 22. The member 14*a* communicates with the interior of the container 18 via the gap between the valve housing 34 and the suction tube 38.

The piston 16 comprises a piston body 16*a* and a seal 16*b* mounted on the piston body 16*a*. A rod 16*c* is integrally formed with the piston body 16*a*. The rod 16*c* extends such that its distal end is located near the hole 34*b* made in the valve housing 34.

The rod 16*c* is inserted into the hole 34*b* when the trigger 12 is pulled to pressurize the liquid in the cylinder 14 thereby to force out the liquid from the orifice 20. The rod 16*c* pushes the packing 35, opening the hole 34*b*. The interior of the container 18 is thereby connected to the atmosphere. Air flows into the container 18, preventing the container 18 from being negatively pressurized. Since the seal 16*b* is separated from the piston body 16*a*, the piston 16 is easy to produce by molding.

Figure 4:
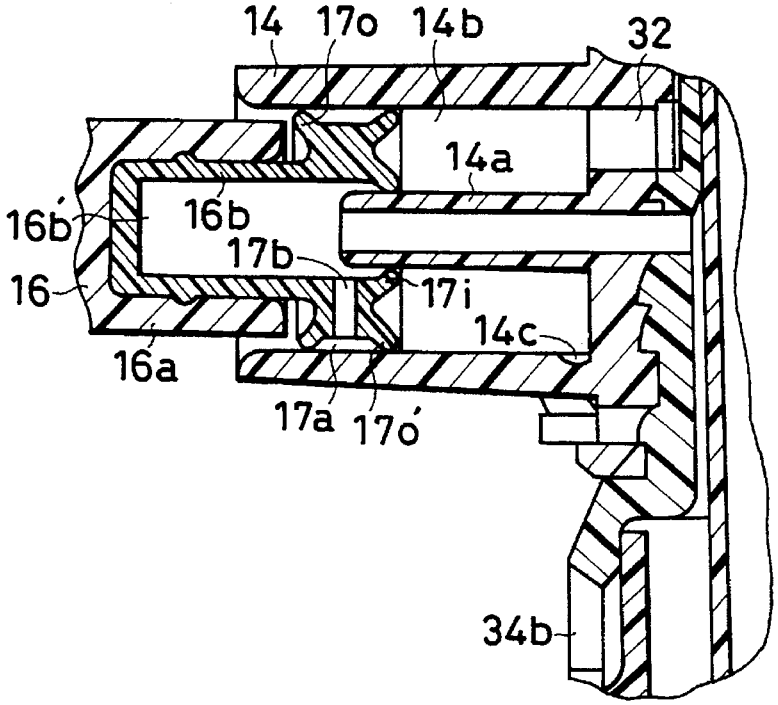
FIG. 4A is a sectional view of a part of the dispenser, showing the piston located at its initial position.
FIG. 4B is a sectional view of a part of the dispenser, showing the piston located in its stroke end.
Figure 4:
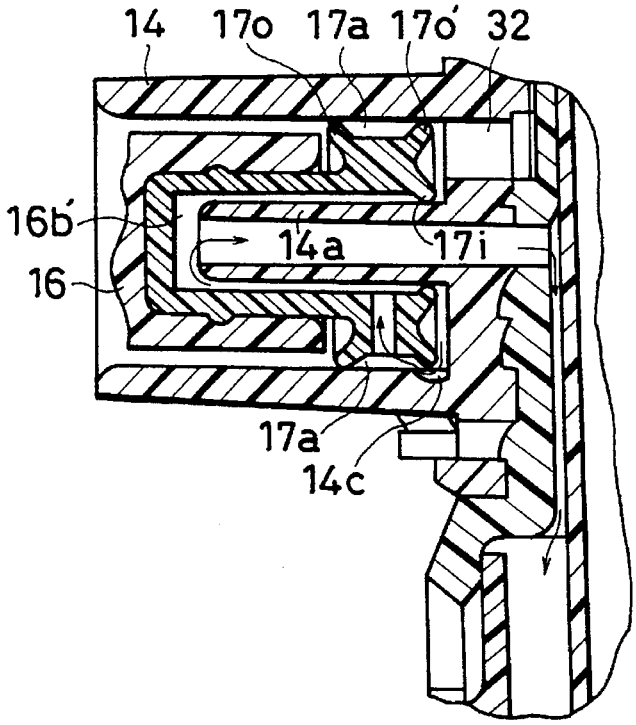

As can be seen from FIGS. 1 and 4, the seal 16*b* of the piston 16 has a recess 16*b'* for receiving the hollow cylindrical member 14*a* of the cylinder 14. An outer skirt-shaped seal 17*o* and an inner skirt-shape, seal 17*i* are mounted on the seal 16*b*. The outer skirt-shaped seal 17*o* is put in sliding contact with the inner circumferential surface of the cylinder 14. The inner skirt-shaped seal 17*i* is set in sliding contact with the outer circumferential surface of the hollow cylindrical member 14*a*. As FIG. 1 shows, the recess 16*b'* of the piston 16 communicates with the interior of the container 18 through the hollow cylindrical member 14*a* and the gap between the valve housing 34 and the suction tube 38.

The outer skirt-shaped seal 17*o* consists of a pair of skirt-shaped seal members which are separated along the axis of the piston 16. An annular space 17*a* is therefore provided among the skirt-shaped seal members and the inner circumferential surface of the cylinder 14. The seal 16*b* has a lateral hole 17*b* which opens between the seal members of the outer skirt-shaped seal 17*o*. The lateral hole 17*b* connects the annular space 17*a* to the recess 16*b'* of the piston 16.

In the unit comprised of the cylinder 14 and the piston 16, the space between the cylinder 14 and the hollow cylindrical member 14*a*, i.e., the cylinder chamber (pressurizing chamber) 14*b*, is partitioned from the recess 16*b'* of the piston 16 by the rear (right) seal number 17*o'* of the outer skirt-shaped seal 17*o* and the inner skirt-shaped seal 17*i*. To connect the cylinder chamber 14*b* to the recess 16*b'*, and escape groove 14*c* is made in the cylinder 14.

The escape groove 14*c* is made in the inner surface of the cylinder 14. It is so positioned that the rear (right) seal member 17*o'* of the seal 17*o* slips into it when the trigger 12 is pulled and swung, pushing piston 16 almost to the stroke end thereof. Once the rear seal member 17*o'* slips into the escape groove 14*c*, the seal member 17*o'* is released from the sliding contact with the cylinder 14. As a result, the cylinder chamber 14*b* comes to communicate with the recess 16*b'* when the piston 16 reaches a position very close to its stroke end. Since the recess 16*b'* communicates with the interior of the container 18, the chamber 14*b* is connected to interior of the container 18 by the recess 16*b'*.

Thus, the chamber 14*b* is connected to the interior of the container 18 when the piston 16 is pushed almost to its stroke end. As the piston 16 approaches its stroke end, it forces the liquid from the cylinder 14 (more precisely, in the chamber 14*b*) back into the container 18 through the recess 16*b'*. It should be noted that the liquid remains in the cylinder 14 while the piston 16 is staying in its pressurizing stroke (i.e., pushed-in stroke).

The liquid, which is pressurized in the cylinder 14 while the piston 16 is in its pressurizing stroke, is made to flow from the orifice 20. Otherwise, the liquid is forced back through the recess 16*b'* into the container 18. No pressurized liquid would therefore remain in the cylinder 14, and no residual pressure is generated in the cylinder 14. Hence, the liquid does not dribble from the orifice 20 and can be efficiently sprayed from the orifice 20.

All the time the piston 16 stays in its virgin stroke (i.e., initial stroke), the cylinder 14 is filled up with air. Even if the air is compressed, the pressure in the cylinder 14 will not rise to a value great enough to open the secondary valve 42 to exhaust the air through the orifice 20. As long as air remains in the cylinder 14, no negative pressure can be generated in the cylinder 14. It is therefore difficult to suck the liquid upward into the cylinder 14 from the container 18.

According to the invention, the air escapes into the container 18 at an early stage of operation. In other words, the air is fast exhausted from the cylinder 14. This is because, as indicated above, the chamber 14*b* is made to communicate with the interior of the container 18 when the piston 16 is pushed almost to its stroke end.

The present invention is not limited to the embodiment described above. Various changes and modifications can be made without departing from the spirit and scope of the invention.

As has been described, pressures are applied on the secondary valve from both sides thereof, and the secondary valve is opened by virtue of the difference in the pressures. The secondary valve does not open until the liquid in the cylinder is sufficiently pressurized to a high pressure. Thus, the liquid is sufficiently pressurized when it is forced out through the orifice. The spring for the secondary valve need not be strengthened, and the liquid can yet be supplied from the cylinder under a high pressure by pulling the trigger with a comparatively small force.

Needless to say, the spring of the secondary valve can be reinforced, without increasing the trigger-pulling force beyond a limited range. The liquid can thereby be prevented from dribbling from the orifice in spite of the residual pressure in the cylinder.

Moreover, the liquid pressurized in the cylinder is either supplied to the orifice or forced back into the container because the cylinder chamber communicates with the interior of the container when the piston is pushed almost to its stroke end. That is, no pressurized liquid remains in the cylinder. No residual pressure exists in the cylinder, whereby the liquid does not dribble from the orifice and is efficiently sprayed therefrom.

The air filled in the cylinder while the piston stays in the virgin stroke escapes into the container at an early stage of operation. Therefore, the air can be easily exhausted from the chamber.

What is claimed is:

1. A manually operated trigger dispenser in which liquid is sucked up into a cylinder, pressurized in the cylinder and supplied from an orifice in response to a piston which reciprocates in response to a trigger which is pulled and swung, the dispenser further comprising:

a flowing-out passage connecting the cylinder to the orifice and comprising a small-diameter portion and a large-diameter portion located near the cylinder and the orifice, respectively, and having a stepped portion at a junction of the small-diameter and large-diameter portions; and a one-way valve provided in the flowing-out passage and having skirt-shaped seals on an outer surface, to prevent communication between the small-diameter and large-diameter portions of the flowing-out passage, wherein the one-way valve has a valve body, a valve seat located near the orifice and a valve spring setting the valve body in contact with the valve seat, and wherein liquid pressures are applied on the valve body from a cylinder side and an orifice side, respectively, thereby to move the valve body from the valve seat against a force of the valve spring by virtue of a difference between liquid pressures applied on the valve body.

2. A one-way valve in a flowing-out passage of a manually operated trigger dispenser in which liquid is sucked up into a cylinder, pressurized in the cylinder and supplied from an orifice in response to a piston which reciprocates in response to a trigger which is pulled and swung, the one-way valve and flowing-out passage further comprising;

a valve body;

a valve seat;

small and large skirt-shaped seals on the valve body and set in sliding contact with different portions of an inner surface of the flowing-out passage which has a stepped portion; and a valve spring integral with the valve body, for setting the valve body in contact with the valve seat, wherein type valve body is moved from the valve seat against a force of the valve spring by virtue of a difference between liquid pressures applied on the valve body from a cylinder side and an orifice side, respectively.

3. The one-way valve according to claim 2, wherein:

the one-way valve further comprises a thick plunger and a thin plunger connected together in axial alignment, the valve spring comprises a spiral portion of the thin plunger, the valve body comprises a portion of the thick plunger, the large skirt-shaped seal is mounted on the thick plunger and faces away from the thin plunger, and the small skirt-shaped seal is mounted on the thick plunger and is located near the thin plunger.

4. The one-way valve according to claim 2, wherein:

the one-way valve comprises a thick plunger and a thin plunger connected together in axial alignment, the valve spring comprises a spiral portion of the thin plunger, the valve body comprises a portion of the thick plunger, the large skirt-shaped seal is mounted on the thick plunger and faces away from the thin plunger, and the small skirt-shaped seal is mounted on the thin plunger and is located near the thick plunger.

5. A manually operated trigger dispenser comprising:

a dispenser body designed to be connected to a mouth of a container filled with a liquid which is to be applied from the dispenser, the dispenser body defining a flowing-in passable and a flowing-out passage;

a trigger swingably connected to the dispenser body and biased by a return spring so as to be pulled and swung against a force of the return spring;

a primary valve provided in the flowing-in passage;

a secondary valve provided in the flowing-out passage;

a cylinder provided in the dispenser body and providing fluid Communication between the flowing-in passage and the flowing-out passage;

an orifice provided at a distal end of the flowing-out passage; and a piston provided in the cylinder and arranged to reciprocate in sliding contact with an inner surface of the cylinder when the trigger is pulled and swung, thereby to suck up the liquid into the cylinder through the flowing-in passage, pressurize the liquid in the cylinder and supply the liquid from the orifice, wherein the flowing-out passage comprises a small-diameter portion and a large-diameter portion located near the cylinder and the orifice, respectively, and has a stepped portion at a junction of the small-diameter and large-diameter portions;

wherein the secondary valve comprises hollow cylindrical thick and thin plungers which move together and are provided in the large-diameter and small-diameter portions of the flowing-out passage, respectively, skirt-shaped seals set in sliding contact with different respective inner surfaces of the flowing-out passage, and a valve spring integral with the thin plunger, setting the thick plunger in contact with a valve seat, said skirt-shaped seals prevent communication between the small-diameter and large-diameter portions of the flowing-out passage; and liquid pressures are applied on the secondary valve from a cylinder side and an orifice side to control the secondary valve by virtue of a difference between liquid pressures applied on the secondary valve.

6. The manually operated trigger dispenser according to claim 5, wherein:

the cylinder is a double-cylinder and has a hollow cylindrical member adapted to communicate with an interior of the container;

the piston has a recess adapted to receive the hollow cylindrical member and to communicate with the interior of the container through the hollow cylindrical member, an outer skirt-shaped seal of the piston being set in sliding contact with an inner surface of the cylinder and an inner skirt-shaped seal being set in sliding contact with an outer surface of the hollow cylindrical member;

the outer skirt-shaped seal comprises a pair of outer skirt-shaped seal members which are spaced apart along the piston and which define an annular space together with the inner surface of the cylinder;

the piston has a lateral hole which opens between the seal members of the outer skirt-shaped seal and connects the annular space to the recess of the piston; and an escape groove is provided in the inner surface of the cylinder and is positioned to receive a rear seal member of the outer skirt-shaped seal, when the piston is pushed almost to a stroke end, thereby to release the rear seal member from sliding contact with the inner surface of the cylinder.

7. The manually operated trigger dispenser according to claim 5, wherein:

the valve spring of the secondary valve comprises a spiral portion of the thin plunger;

a valve body forms a portion of the thick plunger; and the skirt-shaped seals of the secondary valve comprise a large skirt-shaped seal which is mounted on the thick plunger and faces away from the thin plunger, and a small skirt-shaped seal mounted on the thick plunger and located near the thin plunger.

8. The manually operated trigger dispenser according to claim 5, wherein:

the valve spring of the secondary valve comprises a spiral portion of the thin plunger;

a valve body forms a portion of the thick plunger; and the skirt-shaped seals of the secondary valve comprise a large skirt-shaped seal which is mounted on the thick plunger and faces away from the thin plunger, and a small skirt-shaped seal mounted on the thin plunger and located near the thick plunger.

* * * * *

UNITED STATES PATENT AND TRADEMARK OFFICE

CERTIFICATE OF CORRECTION

PATENT NO. : 5,636,768

DATED : June 10, 1997

INVENTOR(S) : YAMADA

It is certified that error appears in the above-indentified patent and that said Letters Patent is hereby corrected as shown below:

Column 10, line 16 (claim 5, line 5),

"passable" should be --passage-- line 24 (claim 5, line 12),

"Communication" should be --communication--

Signed and Sealed this

Twenty-first Day of October 1997

*Attest:*

*Attesting Officer*

BRUCE LEHMAN

*Commissioner of Patents and Trademarks*